US010301148B2

(12) United States Patent
Buck

(10) Patent No.: US 10,301,148 B2
(45) Date of Patent: May 28, 2019

(54) SYSTEM, APPARATUS AND METHODS FOR CORD STORAGE REEL

(71) Applicant: Clayton Buck, Moorseville, NC (US)

(72) Inventor: Clayton Buck, Moorseville, NC (US)

( * ) Notice: Subject to any disclaimer, the term of this patent is extended or adjusted under 35 U.S.C. 154(b) by 225 days.

(21) Appl. No.: 15/131,896

(22) Filed: Apr. 18, 2016

(65) Prior Publication Data

US 2016/0304311 A1 Oct. 20, 2016

Related U.S. Application Data

(60) Provisional application No. 62/148,578, filed on Apr. 16, 2015, provisional application No. 62/151,343, filed on Apr. 22, 2015.

(51) Int. Cl.
*B65H 75/40* (2006.01)
*B65H 75/44* (2006.01)

(52) U.S. Cl.
CPC ..... *B65H 75/40* (2013.01); *B65H 75/4471* (2013.01); *B65H 75/4492* (2013.01); *B65H 2403/481* (2013.01); *B65H 2701/34* (2013.01)

(58) Field of Classification Search
CPC . B65H 75/40; B65H 75/4471; B65H 75/4492
See application file for complete search history.

(56) References Cited

U.S. PATENT DOCUMENTS

| | | | | |
|---|---|---|---|---|
| 2,530,114 | A | 11/1950 | Bugg et al. | |
| D195,463 | S | 6/1963 | Tamarin | |
| 3,929,210 | A | 12/1975 | Cutler et al. | |
| 4,132,367 | A | 1/1979 | Ineson et al. | |
| 4,442,984 | A | 4/1984 | Bayat | |
| 4,721,833 | A | 1/1988 | Dubay | |
| 4,897,512 | A | 1/1990 | Johnston | |
| 5,915,641 | A | 6/1999 | Barberg | |
| 6,056,226 | A * | 5/2000 | Green | B65H 75/364 191/12.2 R |
| 7,109,594 | B2 | 9/2006 | Liao | |
| 7,293,734 | B1 * | 11/2007 | Kantner | B65H 75/305 242/395.1 |
| 7,883,046 | B2 | 2/2011 | Inman et al. | |
| 2011/0198177 | A1 | 8/2011 | Hall | |

* cited by examiner

*Primary Examiner* — Sang K Kim
(74) *Attorney, Agent, or Firm* — J. Curtis Edmondson; Law Offices of J. Curtis Edmondson

(57) ABSTRACT

A cord reel apparatus for holding and winding cords includes a housing, a spool and a handle. The housing and spool further have three outlets to conveniently access the two plugging ends of the cord. The handle extends from exterior of housing and a crank handle internally connected to spool helps in faster and smoother winding and unwinding of the cords. Also the cord reel apparatus includes a gear system (outer, central and inner gears) to help in faster winding and unwinding of cords.

10 Claims, 6 Drawing Sheets

SYSTEM, APPARATUS AND METHODS FOR CORD STORAGE REEL

CROSS REFERENCES TO RELATED APPLICATIONS

This application claims the benefit of U.S. Provisional Patent Application No. 62/148,578 filed Apr. 16, 2015, which is incorporated herein by reference in its entirety. This application also claims the benefit of U.S. Provisional Patent Application No. 62/151,343 filed Apr. 22, 2015, which is incorporated herein by reference in its entirety.

FIELD

The inventive subject matter relates to a method and apparatus for an improved cord storage reel.

BACKGROUND

Building construction sites, where residential and commercial buildings are being fabricated typically use a large number of electrical equipment, such as saws, drills, and other fabricating equipment. It is not uncommon during the building process to have long electrical cords being connected from a central power source, such as a generator or the main utility line.

What is also ubiquitous at a construction site are "five gallon" construction buckets. These buckets are inexpensive and are used to carry tools, construction materials, and water. Also, one can purchase fabric organizers that sit on top, or around the edge of the bucket and have pockets for holding hand tools. These tool management systems that are placed on the buckets also serve are a convenient way to organize and transport tools to and from the construction site.

There are different types of cord and hose management systems. For the purpose of this application, the term "cord" may refer to a cord, hose, wire, rope, fishing line, or other similar type of material.

U.S. Pat. No. 2,801,303 issued to Grace N. Pailing discloses a cord reel for winding and storing the power cords of electrical appliances such as toasters and kitchen mixers.

U.S. Pat. No. 3,313,498 issued to Lawrence W. Wasson discloses a wire dispensing reel particularly useful for dispensing the wire ties that masonry workers use to temporarily hold sections of re-bar together until the concrete can be poured around them and rigidified.

U.S. Pat. No. 4,132,367 issued to Norman Meson et al, assigned to Indicel Co., Ltd. discloses a cord winder that features a number of planetary drums that orbit about a fixed sun drum when driven by a crank or spring motor.

U.S. Pat. No. 6,186,433 issued to James D. Kovacik et al., assigned to Alert Stamping and Mfg. Co., Inc. discloses a manually wound cord storage unit featuring a spool that is rotatably mounted on a hub.

U.S. Pat. No. 6,557,792 issued to Mark Snow discloses an apparatus for storing and dispensing holiday light strings, particularly of the "icicle" variety that feature a plurality of short light segments that hang down orthogonal to the main line.

Accordingly, there exists a need for an improved cord storage reel that can easily wind, unwind and store long wires, cables, and cords more conveniently. And also it would be beneficial to have a protective cover to protect the wires, cables or cords from further physical damage, which could be mounted on a five gallon bucket for ease in portability.

SUMMARY

The present inventive subject matter in its first embodiment describes a cord reel apparatus for holding and winding cords, which includes an internal shaft/spool, a housing, and a handle to facilitate in the process of winding and unwinding of cords. The housing further has three (top, bottom and side) outlets to conveniently provide access to the two plugging ends of the cord.

In a second embodiment is described a gearing mechanism to improve the winding of cords. This gearing mechanism may also be integrated within a protective case, a spool, a gear system, and a handle. A handle is connected to the outer/input gear system to help in faster winding of the cords. This handle may also be placed on the other gears to allow the use of multiple turn ratios.

These and other embodiments are described in more detail in the following detailed descriptions and the figures. The foregoing is not intended to be an exhaustive list of embodiments and features of the present inventive subject matter. Persons skilled in the art are capable of appreciating other embodiments and features from the following detailed description in conjunction with the drawings.

DETAILED DESCRIPTION

According to the first embodiment of the present inventive subject matter, a cord reel that is shaped to fit into the upper portion of a standard five gallon bucket is described. The lip like those found on buckets extends from the side to prevent the reel from going too far into the bucket. The reel is intended to be used either in-hand or within the top of a bucket. This makes the cord reel easier to hold as the longer sized cords are wound up and the reel becomes heavy. This also creates a convenient, centralized place for the consumer to store supplies inside the bucket near their cord.

Figure 1:
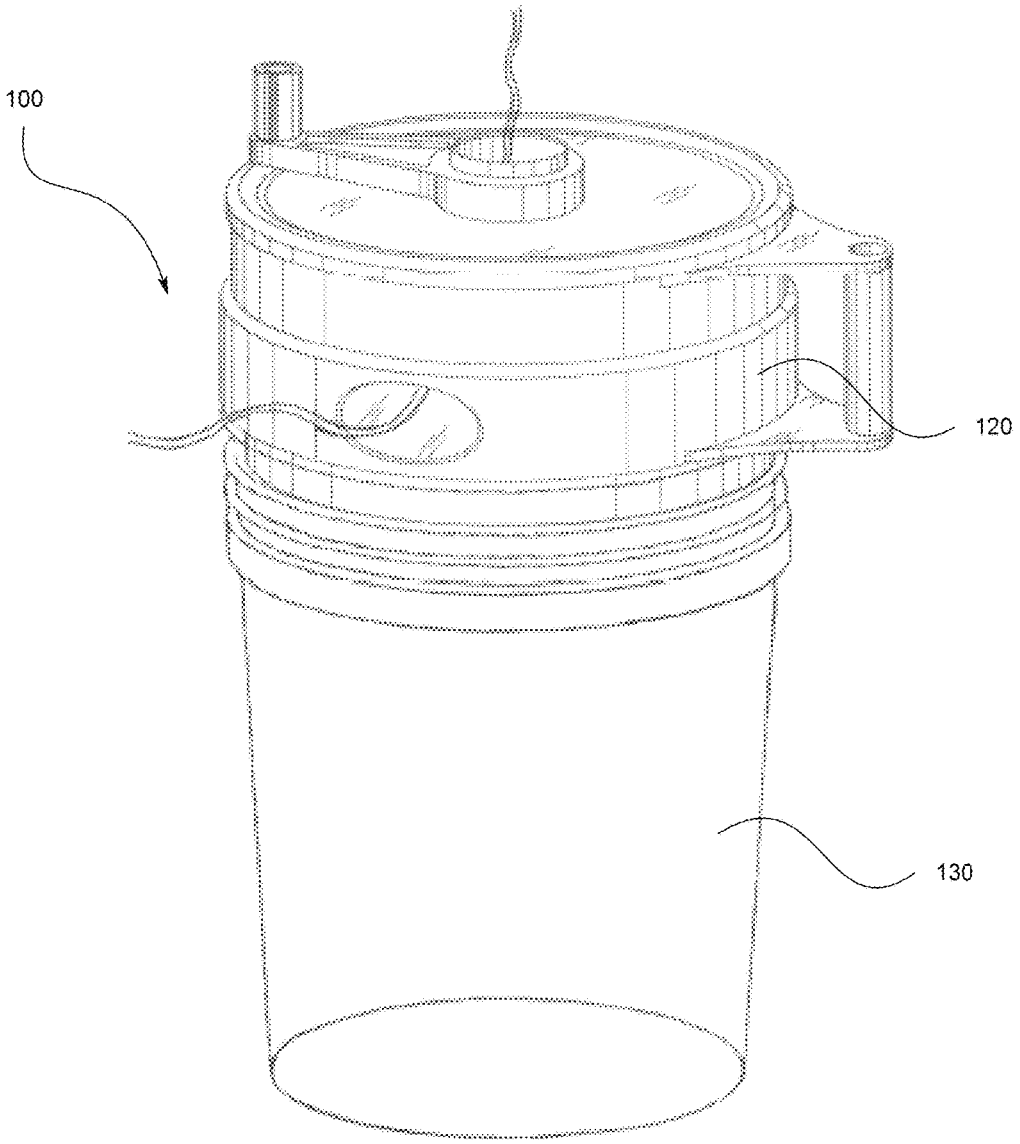
FIG. 1 shows an isometric view of the cord storage reel apparatus according to the first embodiment.
Figure 2:
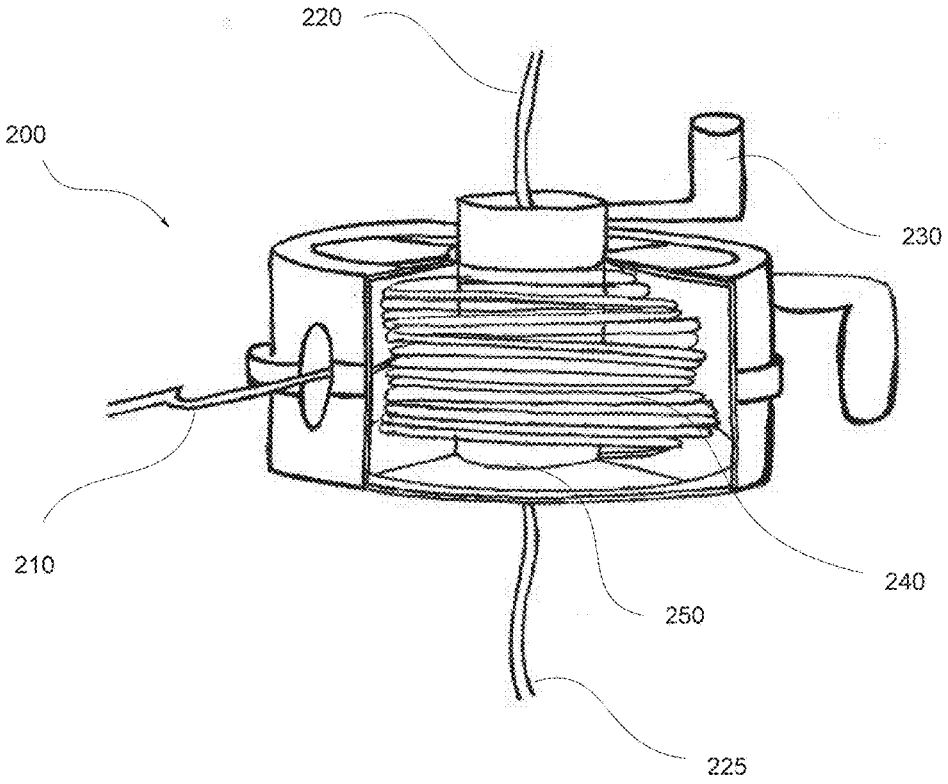
FIG. 2 depicts a side cross section view thereof.

Now referring to FIG. 1 and FIG. 2, specifically FIG. 1 shows the cord reel system 100. The cord reel system 100 is mounted on the work bucket 130 via the cord reel housings compressible flange 120. The compressible flange 120 is fabricated from a rigid material so that a rigid radial perimeter compressibly expands out the inner pliable edge of the work bucket 130. The openings on the top, bottom and side of the spool 250 and housing allow one cord end to remain exposed on either side of the reel while the other end is wound or unwound. It also allows the user to plug into items inside or outside of the bucket while the reel is on top of it. The reel does not have to be opened in order to load the cord and both ends are exposed throughout the winding process, making it unnecessary for the cord to be completely unwound in order to access the plug end.

FIG. 2 depicts a side view of the wire spool 200. The wire spool 200 has a rotating handle 150 that is connected to a hollow internal shaft 250 that allows for cord 240 to be wound on and off the internal shaft 250. The cord 240 has two connection points that are located on the top 220 and on the bottom 225. The method of spooling and unspooling involves rotating the spool in the clockwise and/or counter-clockwise direction. Openings on the top 220, bottom 225 and side 210 of the spool allow one cord end to remain exposed on either side of the reel while the other end is wound or unwound. It also allows the user to plug into items inside or outside of the bucket while the reel is on top of it. The reel does not have to be opened in order to load the cord and both ends are exposed throughout the winding process, making it unnecessary for the cord to be completely unwound in order to access the plug end.

Figure 3:
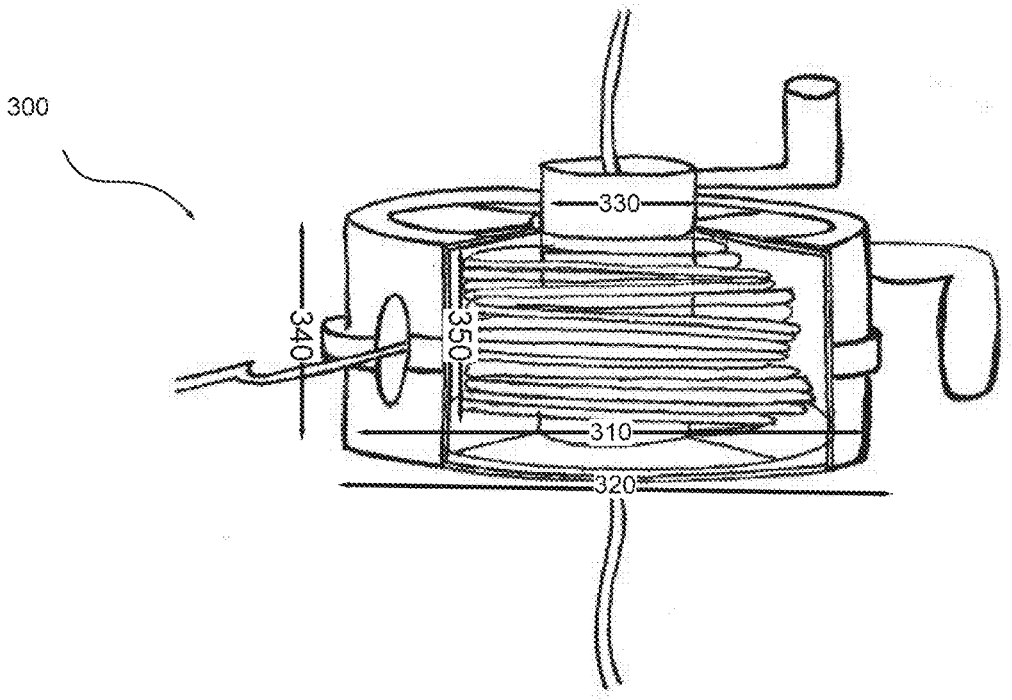
FIG. 3 illustrates the dimensions of the cord storage reel apparatus according to the first embodiment.

FIG. 3 shows the measurements of the different constituents of the cord reel apparatus 300. Several experiments and trials performed have yielded these ideal size/measurements and position for all the constituents for optimizing the ease and pace of operation of winding and unwinding extension cords. For the housing the outer diameter is represented by 310 is no greater than 11 inches, and the outermost diameter including the lip protrusion is represented by 320 is 12 inches and height of the housing is represented by 340 is 4.75 inches are found to be the ideal measurements. For the internal shaft/spool the outer diameter is represented by 330 is 10.8 inches and height is represented by 350 is 4.5 inches are found to be the most ideal measurements for conveniently winding and unwinding a cord up to 50 feet. The cord reel works best when the side outlet is centered on the housing. Based on the length of the cord the dimensions of the constituents would vary to obtain the optimum operational efficiency.

Figure 4:
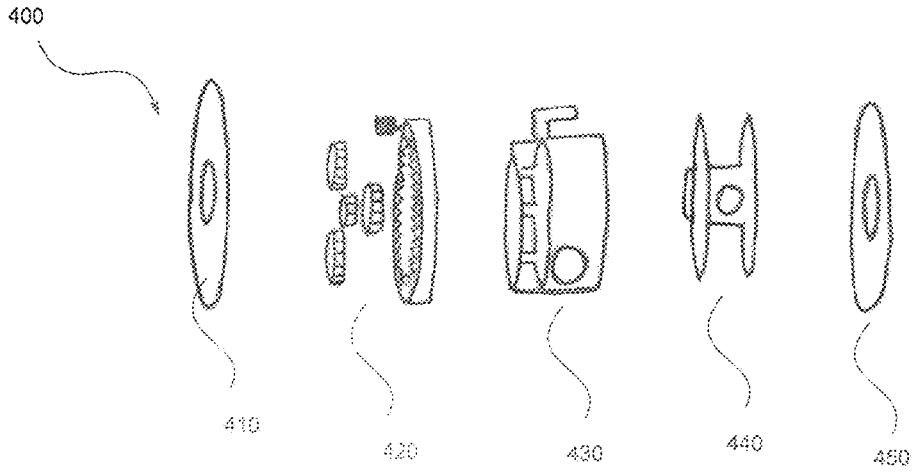
FIG. 4 depicts an exploded view of the cord storage reel apparatus according to the second embodiment.

Now referring to FIG. 4, which shows an exploded view of the cord gearing system 400 according to the second embodiment of the present inventive subject matter. The right side cover is as shown in 410, the gear assembly with the crank handle is as shown in 420, the housing with the carry handle is as shown in 430, the spool is as shown in 440 and the left side cover is as shown in 450. The crank handle or the carry handle having a handle coupling which would be capable of receiving detachable handles. Also the handle coupling can receive foldable handles for compact storage purposes.

Figure 5:
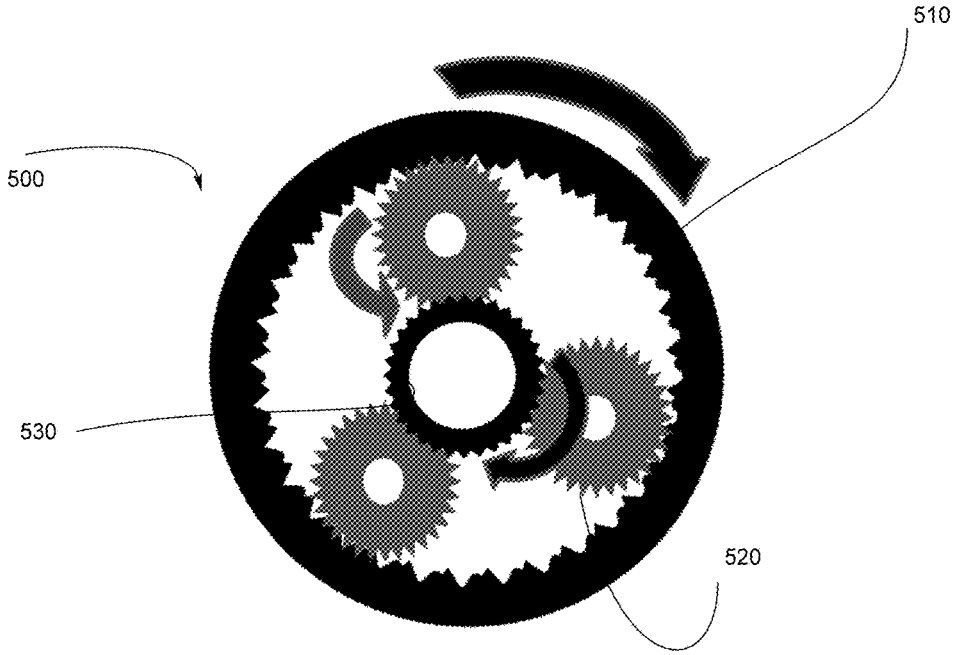
FIG. 5 illustrates a gear mechanism for winding the cord according to the second embodiment.

Now referring to FIG. 5, which shows a top view of a gear assembly 500 that interfaces the outer handle to the internal shaft of the spool and to a gear mechanism. The gear mechanism consists of an outer/input gear 510 connected to three interconnecting gears 520 which are connected to the inner/output gear 530.

Use of the cord reel system involves turning the handle to wind or unwind a cord that is wound on the spool. The outer gear 510 is rotated against the three interconnecting gears 520 that rotate in the opposite direction. When the three interconnecting gears 520 rotate, this causes the turning of the inner/output gear 530. The inner gear/output gear 530 is connected to the spool which results in the overall winding/unwinding of the cords.

The relative gear ratio between the outer gear 510 and the three interconnecting gears 520 may result in high operational efficiency, for example, the fast winding and/or unwinding of long cords. The above description serves as a representative gear system to be used in a cord reel apparatus. A gear system with a different number of gears and different gear ratios can be used to achieve higher operational efficiency.

Figure 6:
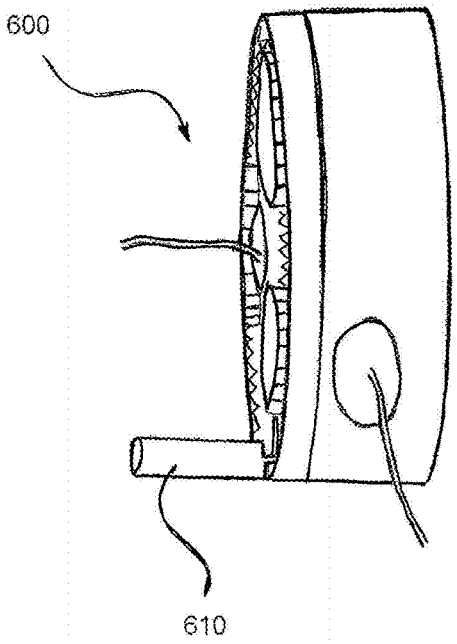
FIG. 6 illustrates a gear mechanism with the crank attached to the outer gear according to the second embodiment.

Now referring to FIG. 6 which depicts the cord reel which uses an outer gear that turns as the attached handle 610 that may be operated by the user. This outer gear turns a smaller gear (in this case three) that turn the central gear which turns the cord spool attached to it, producing a 5:1 crank to turn ratio.

The centering of the gear setup can be achieved by using three or more, evenly sized gears between the outer gear and central gear. The attached spool can become heavy and/or out of balance as a cord is wound, the centering of the gear setup helps maintain the smooth rotation of the spool. The gear mechanism can also accommodate a 1:1 ratio or even negative i.e. 1:2 ratio when the weight of the cord is an issue and greater torque rather than speed is preferred. Different speeds of operation can be achieved by moving the crank handle from the center gear to the outer gear or vice versa based on the requirement.

The ratio produced by this reel makes rolling up a cord much faster but the concept is not limited to this style of reel. Adaptations for reels of many sizes and styles are applicable and the optimal ratio necessary for each type can be achieved by altering the gear size relationships. The central gear may also be hollow, allowing the cable to pass through after exiting the center of the spool. This allows a cord end to be accessible while the spool attached winds the rest of the cord.

The many aspects and benefits of the invention are apparent from the detailed description, and thus, it is intended for the following claims to cover all such aspects and benefits of the invention which fall within the scope and spirit of the invention. In addition, because numerous modifications and variations will be obvious and readily occur to those skilled in the art, the claims should not be construed to limit the invention to the exact construction and operation illustrated and described herein. Accordingly, all suitable modifications and equivalents should be understood to fall within the scope of the invention as claimed herein.

The invention claimed is:

1. A cord reel apparatus comprising:

a housing;

a spool incorporated within and rotatable relative to the housing, the spool further having a shaft;

a multiplicity of interconnected gears proximately located between the housing and the spool;

wherein the spool is externally and rotationally interconnected to the multiplicity of interconnected gears;

a crank handle extending from the housing, the crank handle rotationally attached to the spool by way of the multiplicity of interconnected gears thereby rotating the spool relative to the housing; and a cover, the cover comprising an outer diameter mateably engageable to a perimeter edge of an open top of a container.

2. The cord reel apparatus as in claim 1, wherein the multiplicity of gears further comprises an input gear, a central gear and an output gear.

3. The cord reel apparatus as in claim 2, wherein the output gear to input gear ratio is 1:1.

4. The cord reel apparatus as in claim 2, wherein the output gear to input gear ratio is 1:2.

5. The cord reel apparatus as in claim 2, wherein rotational movement of the crank handle to wind or unwind the cord wound on the spool results in turning of the input gear and the output gear.

6. The cord reel apparatus as in claim 1, wherein the crank handle is attached to the output gear.

7. The cord reel apparatus as in claim 1, wherein the crank handle is attached to the input gear.

8. The cord reel apparatus as in claim 1, wherein the housing further comprises:

a top outlet, a side outlet, a bottom outlet, wherein the top outlet, side outlet, and bottom outlet provide easy access of a female plug end and a male plug end of a cord.

9. The cord reel apparatus as in claim 1 further comprising a handle coupling, the handle coupling capable of receiving a detachable handle.

10. The cord reel apparatus as in claim 9, wherein the handle coupling is foldable.

* * * * *